US011274907B2

(12) United States Patent
Merems et al.

(10) Patent No.: US 11,274,907 B2
(45) Date of Patent: Mar. 15, 2022

(54) SHROUD DRIVEN DEPLOYABLE FLIGHT SURFACES AND METHOD

(71) Applicant: Raytheon Company, Waltham, MA (US)

(72) Inventors: Paul A. Merems, Tucson, AZ (US); Shane Olsen, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 137 days.

(21) Appl. No.: 16/860,530

(22) Filed: Apr. 28, 2020

(65) Prior Publication Data

US 2021/0333074 A1 Oct. 28, 2021

(51) Int. Cl.
*F42B 10/20* (2006.01)

(52) U.S. Cl.
CPC ..... *F42B 10/20* (2013.01)

(58) Field of Classification Search
CPC ..... F24B 10/20; F24B 10/14
See application file for complete search history.

(56) References Cited

U.S. PATENT DOCUMENTS

| | | | | |
|---|---|---|---|---|
| 3,453,960 | A * | 7/1969 | Qualls | F42B 15/38 102/378 |
| 3,946,969 | A | 3/1976 | Marburger et al. | |
| 4,175,720 | A | 11/1979 | Craig | |
| 4,575,025 | A | 3/1986 | Sadvary et al. | |
| 4,659,036 | A | 4/1987 | Pinson | |
| 4,884,766 | A | 12/1989 | Steinmetz et al. | |
| 5,480,111 | A | 1/1996 | Smith et al. | |
| 6,761,331 | B2 | 7/2004 | Eisentraut et al. | |
| 7,093,799 | B1 * | 8/2006 | Dulat | F42B 10/46 244/117 R |
| 7,475,846 | B2 | 1/2009 | Schroeder | |
| 7,642,492 | B2 | 1/2010 | Parine et al. | |
| 8,278,612 | B2 * | 10/2012 | Firor | F42B 10/64 244/3.27 |
| 8,519,312 | B1 * | 8/2013 | Merems | F42B 15/36 244/3.1 |
| 8,931,738 | B2 * | 1/2015 | White | F42B 10/46 244/121 |
| 10,767,968 | B2 * | 9/2020 | Quertelet | F42B 10/46 |
| 2011/0192308 | A1 * | 8/2011 | Fisch | F42B 15/36 102/377 |

* cited by examiner

*Primary Examiner* — Justin M Benedik
(74) *Attorney, Agent, or Firm* — Schwegman Lundberg & Woessner, P.A.

(57) ABSTRACT

A nose or tail assembly for a flight vehicle is provided in which the deployment of the canards or fins is driven by energy imparted by the shroud when it is released. A tip section is rotatably coupled to a base, and both are stowed in a volume between the shroud and nose/tail assembly. As the shroud is released, a drive feature engages the tip section to rotate and join the base to form a complete canard or fin. This eliminates the need for storing the canards or fins in or wrapped around the body and eliminates the need for a complex deployment mechanism occupying an internal volume of the body. Although viable for all sizes of flight vehicles, the shroud-driven deployment system scales to very small diameter vehicles in which internal volume is not available to store either flight surfaces or deployment mechanisms.

22 Claims, 6 Drawing Sheets

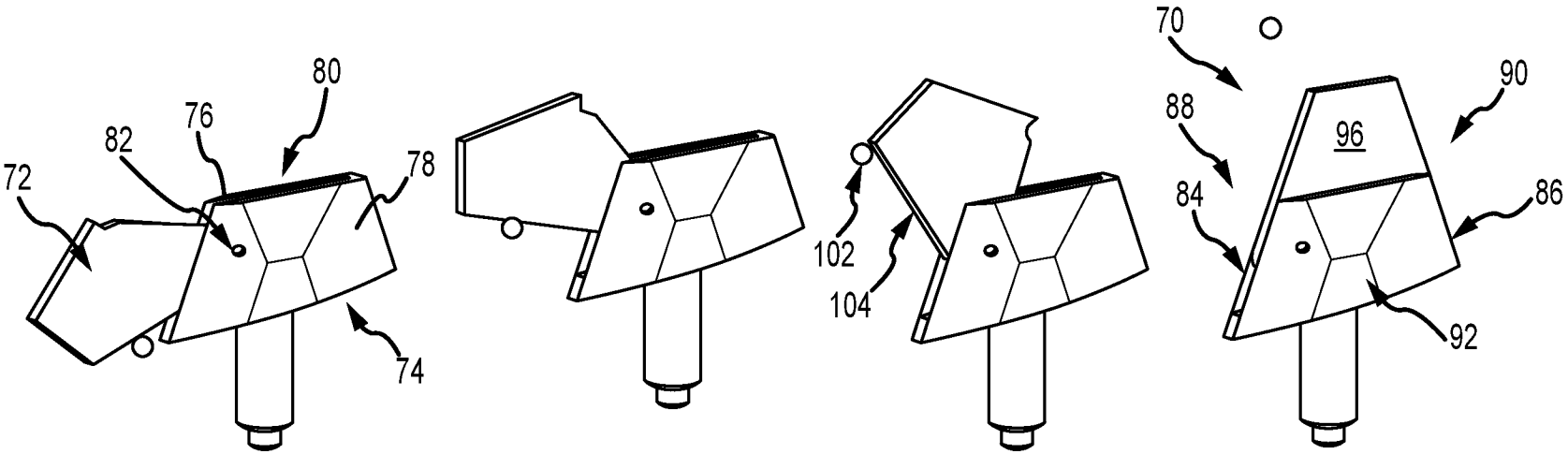
FIG.2a
FIG.2b
FIG.2c
FIG.2d
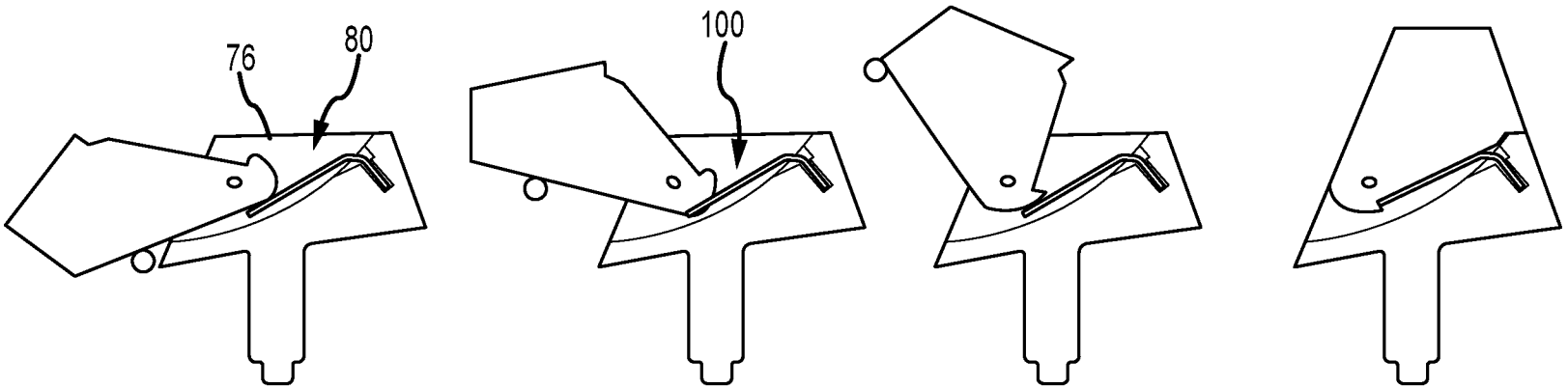
FIG.3a
FIG.3b
FIG.3c
FIG.3d

200

202
206
216
218
214
206
204

SHROUD DRIVEN DEPLOYABLE FLIGHT SURFACES AND METHOD

GOVERNMENT LICENSE RIGHTS

This invention was made with government support under HR0011-15-C-0081 awarded by the Department of Defense. The government has certain rights in this invention.

BACKGROUND OF THE INVENTION

Field of the Invention

This invention relates to flight vehicles that include fixed or controllable flight surfaces that generate aerodynamic forces and/or moments (e.g. canards or fins), and more particularly to flight vehicles that include flight surfaces in a stowed position under a shroud that are capable of moving to a deployed position when the shroud is deployed.

Description of the Related Art

Flight vehicles including but not limited to missiles, rockets, gun-launched projectiles, unmanned aerial vehicles (UAVs), miniature air launched decoys (MALDs), small diameter bombs (SDBs) and the like include fixed or controllable flight surfaces that generate aerodynamic forces and/or moments (e.g. canards or fins) for stabilizing and controlling their flight through the atmosphere. In certain applications there is limited space to stow the flight vehicles or there may be a risk of damaging the flight surfaces prior to or during launch. In particular, in container, tube or gun-launched flight vehicles the flight surfaces must be stowed within or wrapped around the body of the vehicle and deployed after the vehicle clears the container/tube/barrel. A deployment mechanism is positioned inside the body of the vehicle to drive the flight surfaces into position. The deployment mechanism may include motor driven gear assemblies, springs or pyrotechnic charges. By definition, "canards" are positioned forward of any main wing typically just behind the nose cone assembly. "Fins" are positioned at the tail of the vehicle aft of the main wing.

For certain applications a "shroud" is placed over the nose cone and then released in flight. The shroud may perform one or more functions depending on the application. The shroud may be used to simply protect the nose cone during transit, loading and firing from a weapons system. The shroud may form a "sabot" to match smaller diameter projectiles to a larger diameter tube or barrel. The shroud may be used to protect a payload such as an optical seeker for guidance and navigation positioned in the nose cone. The shroud may be used to provide aerodynamic properties for launch or a portion of flight. In some applications the shroud is released immediately as the vehicle exits the tube or barrel. In other applications the shroud may be released in flight just prior to activating the seeker.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a nose or tail assembly for a flight vehicle in which the deployment of the canards or fins is driven by energy imparted by the shroud. A tip section is rotatably coupled to a base, and both are stowed in an external volume between the shroud and nose/tail assembly. As the shroud is released, a drive feature on a shroud segment engages the tip section to rotate and join the base to form a complete canard or fin. This eliminates the need for storing the canards or fins in or wrapped around the body and eliminates the need for a complex deployment mechanism occupying an internal volume of the body. Although viable for all sizes of flight vehicles, the shroud-driven deployment system scales to very small diameter vehicles (e.g., diameter of 3 inches or less) in which the internal volume is not available to store either flight surfaces or deployment mechanisms.

In an embodiment, a nose or tail assembly includes a tapered section positioned fore or aft of the flight vehicle body. A shroud including a plurality of detachable segments defines an external volume between the tapered section and the shroud. A tip section is rotatably attached to a base at pivot point and positioned forward of the base within the external volume in a stowed position. A drive feature is positioned on an interior surface of one of the segments of the shroud forward of the pivot point and adjacent an edge of the tip section in the stowed-position. The drive feature is responsive to in flight release of the shroud to engage the edge and rotate the tip section to a deployed position such that the base and tip section form a complete flight surface. The drive feature suitably contacts and slides along the edge as the tip section as it rotates and disengages prior to full deployment and locking of the complete flight surface.

In an embodiment, the base includes a clevis that includes first and second side members that define a slot such that the tip section rotates on the pivot point into the slot between the first and second side members to form the completed flight surface. The first and second side members forming a portion of both a leading and a trailing edge and a portion of top and bottom surfaces of the complete flight surface. The span of the complete flight surface exceeds that of either the base or the tip section and extends outside the external volume. The slot may be formed with a taper to provide an interference fit with the tip section to slow and possibly lock the tip section. Alternately, a locking mechanism such as a cantilevered spring may be provided in the base to lock the tip section.

In an embodiment, the segments of the shroud are configured to pivot away from the flight vehicle and release to provide a controlled deployment of the tip section. The shroud may include an air intake to pressurize the shroud and pivot the segments away from the flight vehicle.

In an embodiment, a nose assembly has an internal volume that includes a guidance system adjacent the base and tip section in the external volume. The guidance system occupies the space that could be used to otherwise house conventional deployable flight surfaces and the deployment mechanism.

These and other features and advantages of the invention will be apparent to those skilled in the art from the following detailed description of preferred embodiments, taken together with the accompanying drawings, in which:

BRIEF DESCRIPTION OF THE DRAWINGS

FIGS. 2*a* through 2*d* and 3*a* through 3*d* are perspective and section views of an embodiment of shroud driven tip section rotated to join a base to form a complete canard;

DETAILED DESCRIPTION OF THE INVENTION

Figure 1B:
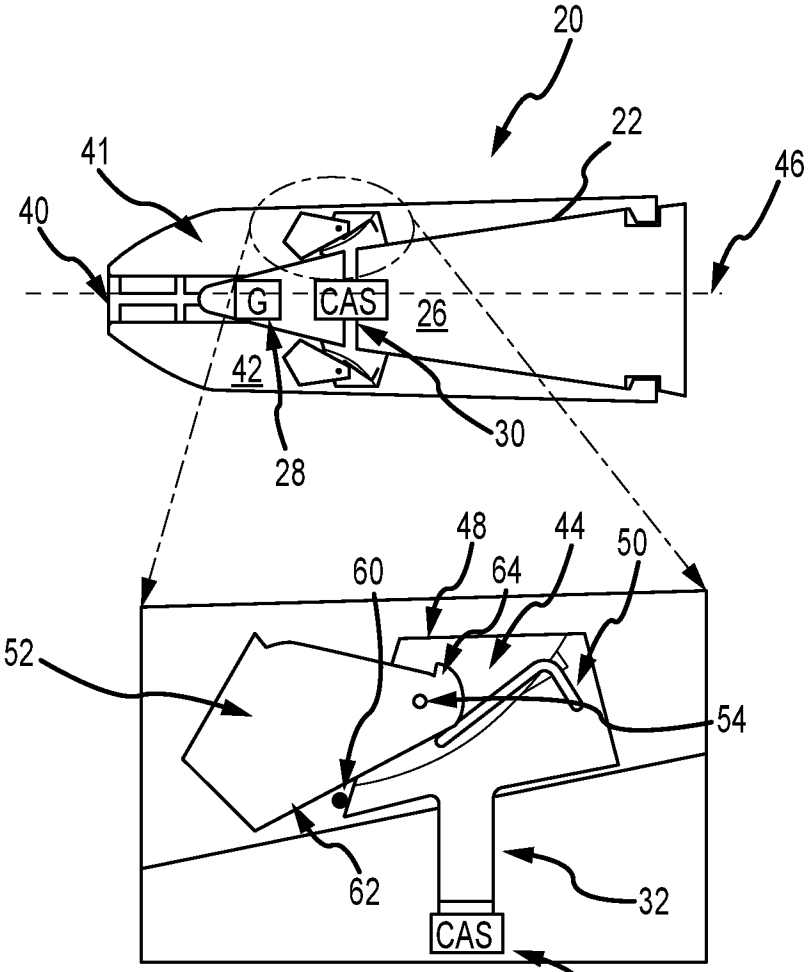
FIGS. 1*a* through 1*d* are different views of an embodiment of nose cone assembly for a flight vehicle in which deployment of the canards is driven by the release of the shroud.
Figure 1A:
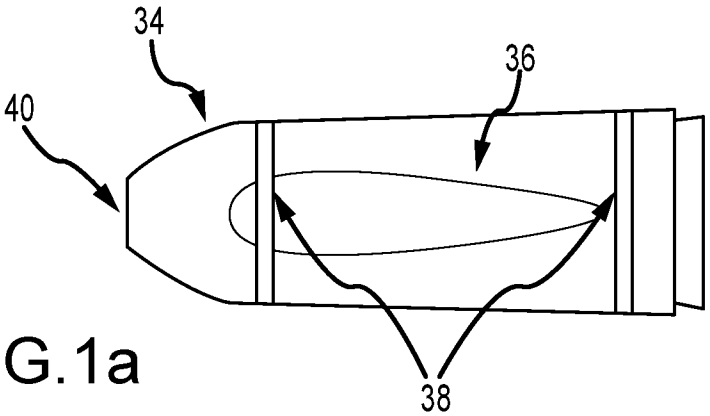
Figure 1D:
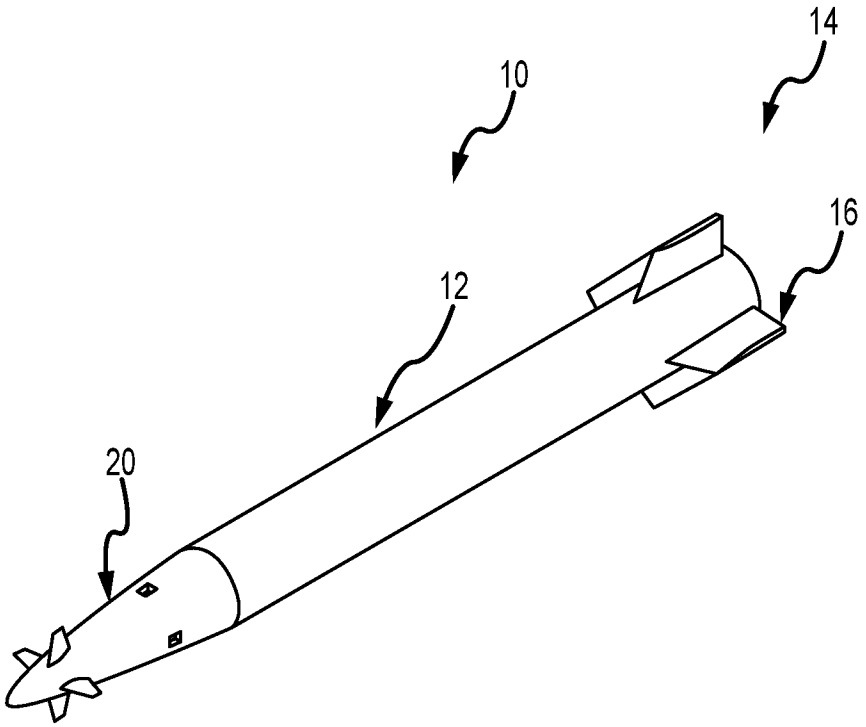
Figure 1C:
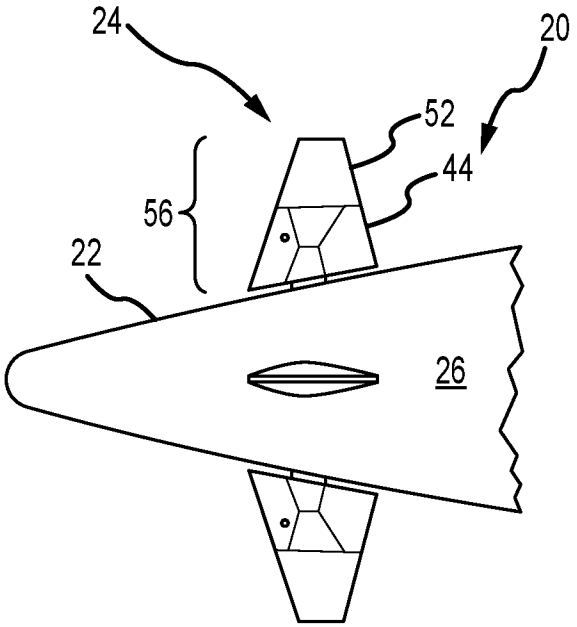

The present invention provides a nose or tail assembly for a flight vehicle in which the deployment of the fixed or controllable canards or fins is driven by energy imparted by the shroud. A tip section is rotatably coupled to a base, and both are stowed in an external volume between the shroud and nose/tail assembly. As the shroud is released, a drive feature on a shroud segment engages the tip section to rotate and join the base to form a complete canard or fin. This eliminates the need for storing the canards or fins in or wrapped around the body and eliminates the need for a complex deployment mechanism occupying an internal volume of the body. In a nose assembly that internal volume may be occupied by a guidance system for example. In a tail assembly that internal volume may be occupied by a motor for example. In either case, there is little internal volume left to store canards/fins and the deployment mechanism. Although viable for all sizes of flight vehicles, the shroud-driven deployment system scales to very small diameter vehicles (e.g., diameter of 3 inches or less) in which the internal volume is not available to store either flight surfaces or deployment mechanisms.

The present invention is applicable to all types of flight vehicles in which internal volume is limited and the need for flight surfaces with an extended span is present. Flight vehicles may include but are not limited to missiles, rockets, gun-launched projectiles, unmanned aerial vehicles (UAVs), miniature air launched decoys (MALDs), small diameter bombs (SDBs) and the like. These vehicles are typically launched from a container, tube or gun barrel although the invention is applicable to other launch modes. Typically the shroud and flight surfaces will open at launch as the vehicle exits the container, tube or barrel. However, in certain applications deployment of the shroud and flight surfaces may occur in flight, for example, just prior to activating an optical seeker. The flight surfaces may be fixed or controllable. Without loss of generality, the present invention will be described in context of a small diameter gun-launched guided projectile in which the nose cone assembly is provided with shroud-driven deployable canards.

Referring now to FIGS. 1*a*-1*d*, an embodiment of gun-launched projectile 10 includes a body 12 that is less than 3 inches in diameter, a tail section 14 with conventionally deployed tail fins 16 in which a motor and gear driven deployment mechanism 18 is stored inside the tail section 14 around the motor tube and a nose cone assembly 20.

The nose cone assembly 20 includes a tapered nose section 22 outfitted with shroud-driven deployable canards 24. An internal volume 26 of nose section 22 is suitably provided with sensors and a guidance system "G" 28. The guidance system 28 may comprise an optical seeker in which case the nose section is formed from an optically transparent material of a GPS. A control actuation system (CAS) 30 is positioned within the internal volume to drive a control rod 32 to rotate the canards 24.

A shroud 34 includes a plurality of segments 36 that are detachably mounted around the circumference of the tapered nose section 22 for in flight release. In this embodiment, segments 36 are held in place by bands 38 around the shroud, which are cut by the barrel rifling during launch. Air enters an intake 40 at the tip of shroud 34 producing pressure on the interior surfaces 41 of the segments causing them to expand moving backwards and outwards until the segments detach.

Shroud 34 defines an external volume 42 between the tapered nose section 22 and the shroud. In this embodiment, four bases 44 mounted on the nose section within the external volume at 90 degree spacing around the circumference of the nose section in mechanical cooperation with control rods 32. Bases 44 are nominally aligned parallel to a central axis 46 of the projectile. An outer edge 48 of each base 44 is suitably adjacent an interior surface of the shroud segment. Each base 44 is suitably provided with a lock mechanism 50 shown here as a cantilevered spring.

Four tip sections 52 are rotatably attached to the respective bases 44 at pivot point 54. Each tip section 52 is positioned forward of the base 44 within the external volume in a stowed position. The base 44 and tip section 52 are designed such that when the tip section 52 rotates to engage the base in a full-deployed position the base 44 and tip section 52 form a complete canard 24 having a span 56 that extends outside the external volume and the diameter of the projectile. Span 56 is greater than the span of either the base or tip section individually. In typical applications base and tip section will each provide about half of the total span.

A like plurality of drive features 60, here four, are formed on interior surfaces 41 of respective shroud segments 36. In this embodiment, the number of segments equals the number of canards. Alternately, the number of segments could be greater than the number of canards with some segments not including a drive feature. The drive feature 60 is positioned forward of the pivot point 54 adjacent an edge 62 of tip section 52 in the stowed-position. As the shroud releases in flight, drive feature 60 engages edge 62 and rotates the tip section to a deployed position such that the base and tip section form complete canard 24. A portion of tip section 52 is formed with a detent 64 that rotates past and engages the cantilever spring to lock the tip section in place.

The shroud-driven canard deployment system resides entirely in the external volume 42 between the nose section 22 and shroud 34. No components of either the canard or the deployment mechanism occupy any of the internal volume 26 of the nose section. That internal volume albeit small is reserved for the guidance system and the CAS. Furthermore, the system only utilizes energy in the shroud segments as they release to deploy and lock the tip sections to form the complete canard 24. No deployment mechanisms such as motors, spring or pyrotechnic device that store and then release energy, which typically occupy a portion of the internal volume, are used.

Referring now to FIGS. 2*a*-2*d* and 3*a*-3*d*, in an embodiment a complete canard 70 is formed by rotating a tip section 72 from stowed position to a fully deployed and locked position to mate with a base 74. Base 74 includes a clevis in which first and second side members 76 and 78 define a slot 80 such that the tip section 72 rotates on a pivot point 82 into the slot 80 between the first and second side members 76 and 78 to form the completed canard 70. The first and second side members form portions 84 and 86 of both leading and trailing edge 88 and 90, a portion 92 of a top surface 96 and a portion of a bottom surface (not shown) of the complete canard 70. Slot 80 may be tapered to narrow as the tip section is received to form an interference fit. The interference fit may function to slow down the rotation of the tip section so that it is captured by the cantilevered spring 100. Alternately, the interference fit may provide the locking mechanism.

A drive feature 102 on an interior surface of a shroud segment is position forward of pivot point 82 adjacent an edge 104 of tip section 72. The drive feature 102 may rest against edge 104 or be slightly spaced apart therefrom in the stowed position. Drive feature 102 such as a drive pin preferably has a rounded surface so that it contacts and slides along edge 104 as the tip section rotates to full deployment. The drive feature 102 disengages edge 104 as the tip section continues to rotate prior to full deployment. The tip section carries sufficient momentum to continue rotating to a deployed and locked position. It is important that the drive feature 102 disengage prior to full deployment to avoid damage to the complete canard 70.

Figure 4B:
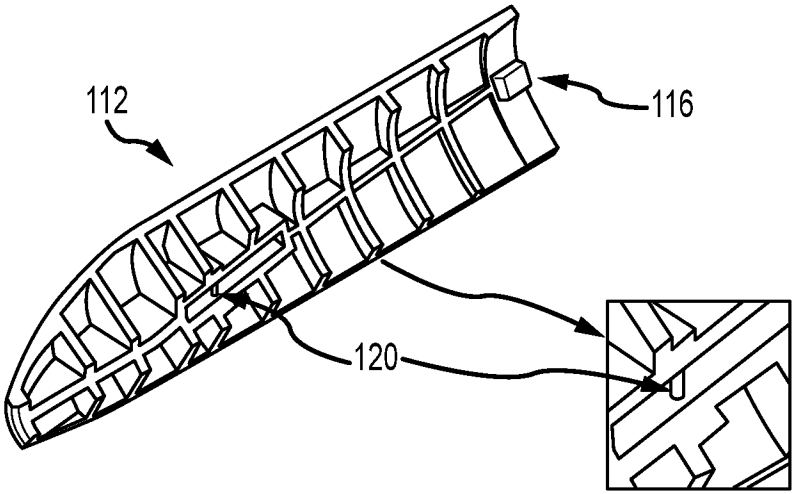
FIGS. 4*a* through 4*c* are different views of an embodiment of a segmented shroud for driving the deployment of the tips to form a complete canard.
Figure 4A:
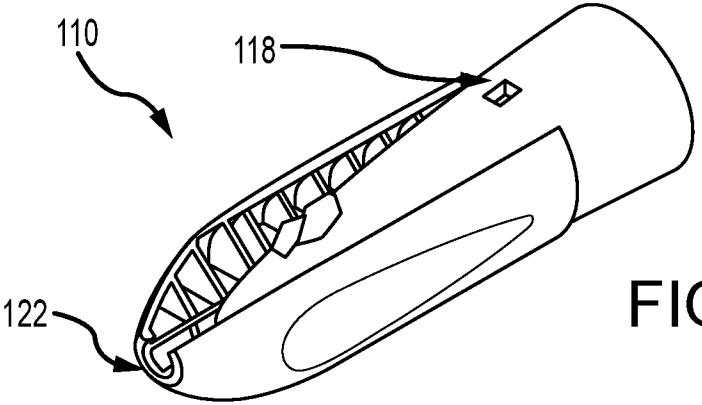
Figure 4C:
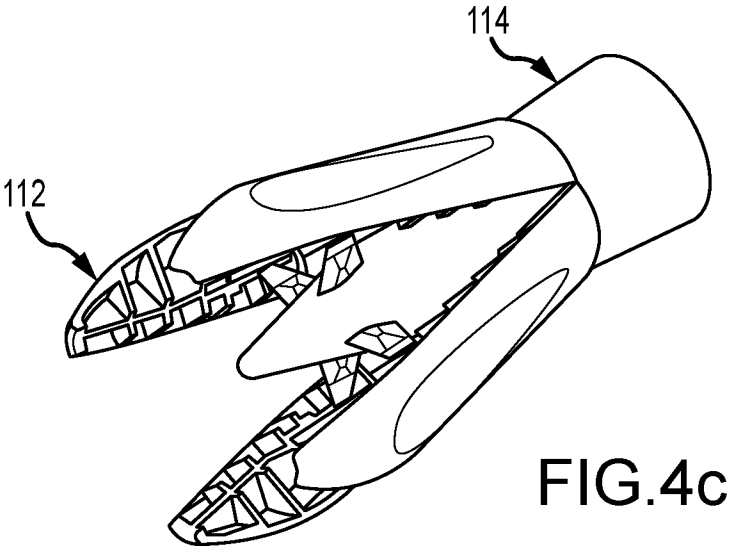
Figures 5A, 5B, 5C, 5D, 5E:
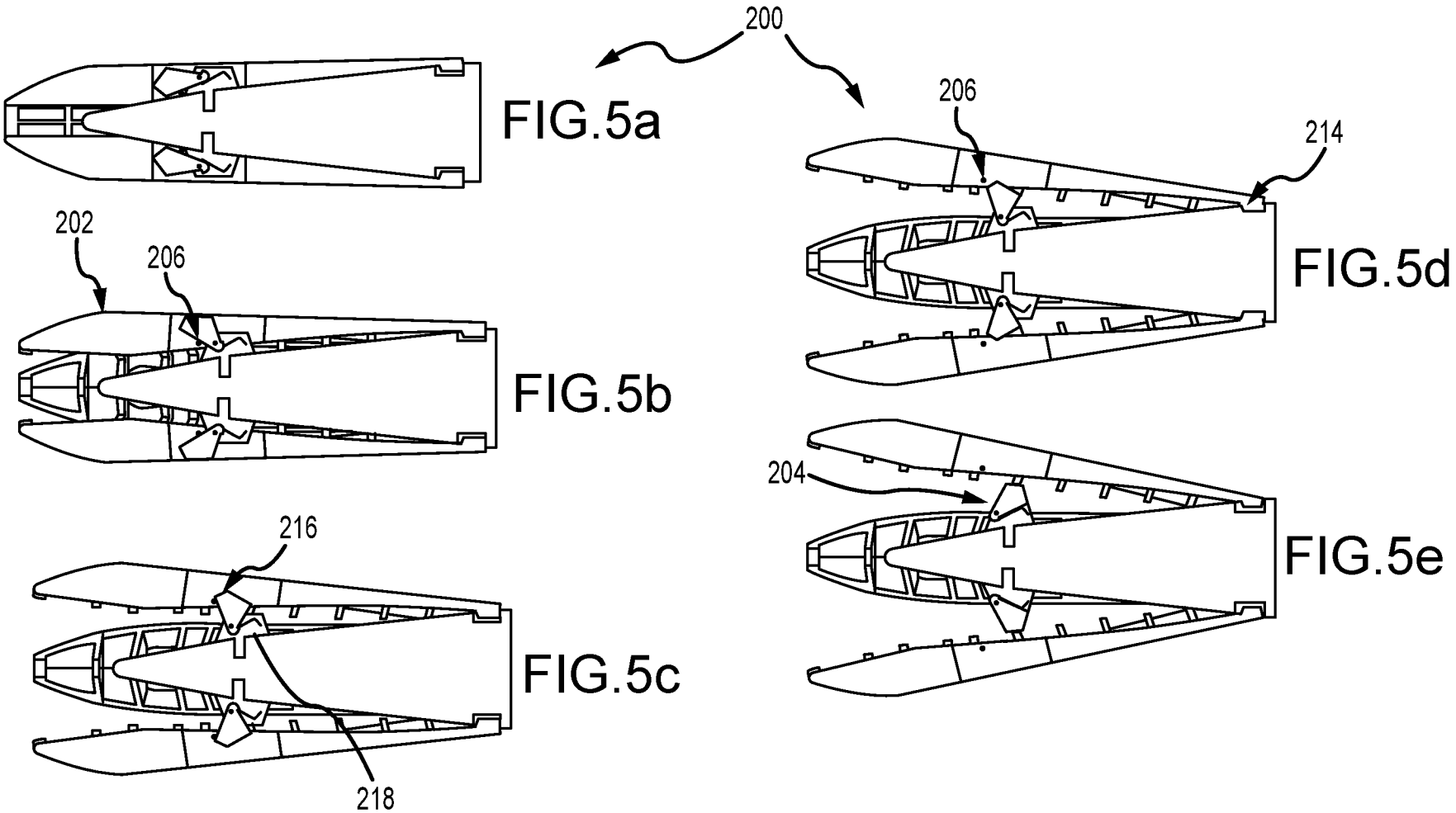
FIGS. 5*a* through 5*e* are views of an embodiment of the deployment of the segmented shroud to deploy the canards.
Figures 6A, 6B:
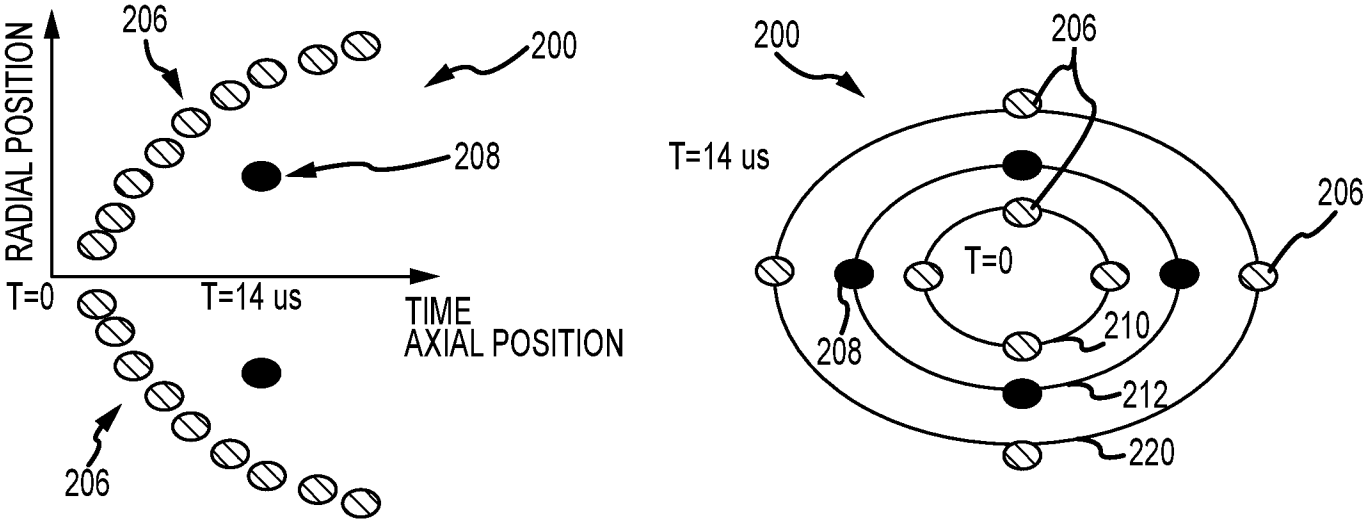
FIGS. 6*a* and 6*b* are different views of the deployment of the segmented shroud to track the position of the drive feature relative to the pivot point.

Referring now to FIGS. 4*a*-4*c*, an embodiment of a shroud 110 includes four segments 112 that are detachably mounted around the circumference of a tapered nose section 114 for in flight release. Each segment 112 is provided with a hinge boss 116 at its aft end that is configured to mate with a hinge notch 118 formed on nose section 114. The "hinge" formed by the hinge boss 116 and hinge notch 118 allows the segment 112 to pivot away from the nose section 114 in a controlled manner such that a drive pin 120 engages and rotates a tip section and then disengages the tip section prior to full deployment. Air enters an intake 122 at the tip of shroud 110 producing pressure on the interior surfaces of the segments causing them to expand and pivot about the hinge moving backwards and outwards until the segments detach. In other embodiments, a pyrotechnic charge may be used to release the shroud segments.

Referring now to FIGS. 5*a*-5*e* and FIGS. 6*a*-6*b*, in an exemplary embodiment of a shroud deployment sequence 200 starts at t=0 with a shroud angle of 0° prior to initiating deployment of the shroud segments 202 and canards 204. At t=0, the shroud is closed and the drive pin 206 is positioned forward and below (between the pivot point and longitudinal axis of the projectile) a pivot point 208. In alternate embodiments, the drive pin may not be positioned below the pivot point in the stowed position. At t=0, the four drive pins 206 lie on a circle 210 whose diameter is less than a circle 212 through the pivot points 208.

As the shroud begins to open up and the segments 202 pivot off a hinge point 214, the drive pin 206 moves backwards (aft) and outwards (away from the longitudinal axis) such that the drive pin 206 engages and rotates the tip section 216 about pivot point 208 in base 218. In this embodiment, at shroud angle 14° the drive pin 206 has disengages from tip section 216. The momentum of the tip section carries it to mate and lock into base 218 to form the complete canard 204 at shroud angle 16°. At release, the drive pin 206 may be fore or aft of pivot point 208 depending on the geometry of the base and tip section and the location of pivot point 208. At release, the drive pin 206 is above the pivot point and the four drive pins 206 lie on a circle 220 whose diameter is greater than the circle 212 through the pivot points 208.

As previously mentioned, the present invention for shroud-driven deployment of flight surfaces can be implemented in the tail assembly of a flight vehicle. In such an embodiment, the aft section of the flight vehicle would taper to a diameter less than the body. As with the nose cone assembly, a plurality of bases would be positioned around the tapered tail section. A like number of tip sections would be rotatably mounted to the bases and positioned forward when stowed. A segmented shroud would cover the tail section and provide drive features to rotate and deploy the tip sections to form complete tail fins. The difference in implementation would be in the shroud. The segments would have to be hinged at the smallest diameter portion at the aft end of the vehicle. Air intakes would be provided around the circumference of the vehicle to pressurize and release the shroud segments. Alternately a different mechanism such as a pyrotechnic charge could be used to release the segments.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A flight vehicle, comprising:

a body;

a tapered section positioned fore or aft of the body;

a shroud including a plurality of segments that define an external volume between the tapered section and the shroud, said segments detachably mounted for in flight release;

a base mounted on the tapered section within the external volume;

a tip section rotatably attached to the base at a pivot point, said tip section positioned forward of the base within the external volume in a stowed position; and a drive feature on an interior surface of one of the segments of the shroud, said drive feature positioned forward of the pivot point adjacent an edge of the tip section in the stowed-position, said drive feature responsive to in flight release of the shroud to engage the edge and rotate the tip section to a deployed position such that the base and tip section form a complete flight surface.

2. The flight vehicle of claim 1, wherein the body has a diameter of 3 inches or less.

3. The flight vehicle of claim 1, wherein the base, tip section and drive feature only occupy the external volume in the stowed position without any penetration of the tapered section.

4. The flight vehicle of claim 1, wherein the drive feature disengages the edge of the tip section prior to formation of the complete flight surface.

5. The flight vehicle of claim 1, wherein the drive feature contacts and slides along the edge of the tip section as the tip section rotates.

6. The flight vehicle of claim 1, wherein in the stowed position the drive feature is positioned between the pivot point and a longitudinal axis of the body.

7. The flight vehicle of claim 1, wherein the base includes a clevis that includes first and second side members that define a slot such that the tip section rotates on the pivot point into the slot between the first and second side members to form the completed flight surface, said first and second side members forming a portion of both a leading and a trailing edge and a portion of top and bottom surfaces of the complete flight surface.

8. The flight vehicle of claim 7, wherein the slot is tapered to form an interference fit with the tip section.

9. The flight vehicle of claim 1, wherein a span of the complete flight surface exceeds the span of either the base or the tip section and extends outside the volume.

10. The flight vehicle of claim 1, wherein the segments of the shroud are configured to pivot away from the flight vehicle and release.

11. The flight vehicle of claim 10, wherein the shroud includes an air intake that provides pressure to pivot the segments away from the flight vehicle.

12. The flight vehicle of claim 1, wherein the tapered section is a nose cone assembly having an internal volume that includes a guidance system adjacent the base and tip section in the external volume.

13. A nose assembly for a flight vehicle, comprising:

a nose cone;

a shroud including a plurality of segments that define an external volume between the nose cone and the shroud, said segments detachably mounted for in flight release;

a base mounted on the nose cone within the external volume;

a tip section rotatably attached to the base at a pivot point such that the tip section moves between a stowed position within the external volume forward of the base and a deployed position such that the base and tip section form a complete canard; and a drive feature on an interior surface of one of the segments of the shroud such that the drive feature moves from a stowed position forward of the pivot point adjacent an edge of the tip section to engage and rotate the tip section to its deployed position.

14. The nose assembly of claim 13, wherein the body has a diameter of 3 inches or less.

15. The nose assembly of claim 13, wherein the drive feature contacts and slides along the edge of the tip section as the tip section rotates and disengages the edge of the tip section prior to formation of the complete canard.

16. The nose assembly of claim 13, wherein the base includes a clevis that includes first and second side members that define a slot such that the tip section rotates on the pivot point into the slot between the first and second side members to form the complete canard, said first and second side members forming a portion of both a leading and a trailing edge and a portion of top and bottom surfaces of the complete canard.

17. The nose assembly of claim 13, wherein the segments of the shroud are configured to pivot away from the nose cone and release.

18. A method of deploying a flight surface on a flight vehicle, said flight vehicle including a body, a tapered section positioned fore or aft of the body, and a shroud including a plurality of detachable segments that define an external volume between the tapered section and the shroud, the method comprising:

attaching a base to the tapered section within the external volume;

rotatably coupling a tip section to the base at a pivot point, stowing the tip section within the external volume forward of the base in a stowed position;

mounting a drive feature on an interior surface of one of the segments of the shroud forward of the pivot point adjacent an edge of the tip section in the stowed-position; and detaching the shroud segments in flight such that the drive feature engages the edge and rotates the tip section about the pivot point into a deployed position such that the base and tip section form a complete flight surface.

19. The method of claim 18, wherein the body has a diameter of 3 inches or less.

20. The method of claim 18, wherein the drive feature contacts and slides along the edge of the tip section as the tip section rotates and disengages the edge of the tip section prior to formation of the complete flight surface.

21. The method of claim 18, wherein the base includes a clevis that includes first and second side members that define a slot such that the tip section rotates on the pivot point into the slot between the first and second side members to form the completed flight surface, said first and second side members forming a portion of both a leading and a trailing edge and a portion of top and bottom surfaces of the complete flight surface.

22. The method of claim 18, further comprising:

configuring the segments of the shroud to pivot away from the nose cone and release.

* * * * *